US012416141B2

(12) United States Patent
Chen et al.

(10) Patent No.: US 12,416,141 B2
(45) Date of Patent: Sep. 16, 2025

(54) CONNECTOR FOR INSTALLING SINK, SINK AND SINK ASSEMBLY

(71) Applicant: FORTUNE INDUSTRIAL (VIETNAM) JOINT STOCK COMPANY, Trang Bang Town (VN)

(72) Inventors: Cali Chen, Trang Bang Town (VN); Mincong Ye, Trang Bang Town (VN)

(73) Assignee: FORTUNE INDUSTRIAL (VIETNAM) JOINT STOCK COMPANY, Trang Bang Town (VN)

( * ) Notice: Subject to any disclaimer, the term of this patent is extended or adjusted under 35 U.S.C. 154(b) by 118 days.

(21) Appl. No.: 18/422,154

(22) Filed: Jan. 25, 2024

(65) Prior Publication Data

US 2025/0243651 A1 Jul. 31, 2025

(51) Int. Cl.
*E03C 1/33* (2006.01)

(52) U.S. Cl.
CPC ..... *E03C 1/33* (2013.01)

(58) Field of Classification Search
CPC ..... E03C 1/33
See application file for complete search history.

(56) References Cited

U.S. PATENT DOCUMENTS 5,653,550 A * 8/1997 Mutz ..... E03C 1/33 403/397
6,745,416 B2 * 6/2004 Albarran ..... E03C 1/335 4/633
2021/0172160 A1 * 6/2021 Bomatter ..... E03C 1/33

* cited by examiner

*Primary Examiner* — Christine J Skubinna
(74) *Attorney, Agent, or Firm* — JEEN IP LAW, LLC

(57) ABSTRACT

The present invention relates to the technical field of sink installation accessories, in particular to a connector for installing a sink, a sink and a sink assembly. The connector includes an integrally formed main body which comprises a vertical part; a lower end of the vertical part is bent to an upper right to form a curved part; the curved part extends to the upper right with several elastic members; and the elastic member comprises a first and a second elastic pressing part, wherein the second elastic pressing part is formed by cutting and bending a middle part of the first elastic pressing part, and a second folding section on the second elastic pressing part is located just below a first folding section on the first elastic pressing part, thereby sharing part of a force while shortening a force arm and further improving the fatigue resistance of the elastic member.

10 Claims, 3 Drawing Sheets

CONNECTOR FOR INSTALLING SINK, SINK AND SINK ASSEMBLY

TECHNICAL FIELD

The present invention relates to the technical field of sink installation accessories, in particular to a connector for installing a sink, a sink and a sink assembly.

BACKGROUND

The prior art discloses a connector for fixing a sink on a work surface. The work surface has a cutout for installing the sink. The cutout has a peripheral boundary surface. The connector has: a base body used as a supporting member, for supporting the sink; and at least one spring member protruding from a first side surface of the base body; wherein each spring member is configured as a tongue protruding from the base body in an edge region of the base body. Each tongue firstly has a first extension section, and the first extension section is connected to a second extension section. The tongue extends substantially perpendicular to the base body at the first extension section, and extends in an acute angle substantially less than 30 degrees relative to the base body at the second extension section. In addition, the spring member or tongue also has a third extension section, and the third extension section is connected to the second extension section. At the third extension section, the spring member is bent to a greater extent than at the second extension section away from the base body, and the spring member is widened at a partial area of the third extension section relative to the second extension section.

The third extension section of the above technology is to abut a force-bearing point against the boundary surface. Since a force arm between the first extension section and the third extension section is longer, the force-bearing point only has the third extension section, further making the spring member's fatigue resistance weak. Therefore, there is room for improvement in the fatigue resistance of the spring member.

SUMMARY

In order to solve the above technical problems, the object of the present invention is to provide a connector for installing a sink with good fatigue resistance, a sink and a sink assembly.

The technical solutions adopted by the present invention to solve the problem are:

a connector for installing a sink, including an integrally formed main body, wherein the main body includes a vertical part, a lower end of the vertical part is bent to an upper right to form a curved part; the curved part is connected with several elastic members, and the elastic members are inclined to the upper right; the elastic member includes a first elastic pressing part and a second elastic pressing part, and the second elastic pressing part is formed by cutting and bending a middle entity of the first elastic pressing part; upper ends of the first elastic pressing part and the second elastic pressing part are respectively folded rightward to form a first folding section and a second folding section; and the second folding section is located below the first folding section.

As a further improvement of the above technical solution, the curved part is also connected with several third elastic pressing parts, the third elastic pressing parts are inclined to the upper right, and upper ends of the third elastic pressing parts are folded rightward to form a third folding section; and a height of the third folding section is lower than that of the second folding section.

As a further improvement of the above technical solution, an angle between the third elastic pressing part and the vertical part is greater than an angle between the second elastic pressing part and the vertical part, and the angle between the second elastic pressing part and the vertical part is greater than an angle between the first elastic pressing part and the vertical part.

As a further improvement of the above technical solution, an angle between the third elastic pressing part and the second elastic pressing part is greater than an angle between the second elastic pressing part and the first elastic pressing part.

As a further improvement of the above technical solution, the angle between the third elastic pressing part and the vertical part is less than or equal to 45°.

As a further improvement of the above technical solution, the elastic member and the third elastic pressing part are alternately arranged in a length direction of the main body.

As a further improvement of the above technical solution, the main body also includes a transverse part, and the transverse part is located at an upper end of the vertical part.

As a further improvement of the above technical solution, a projection of the first folding section in a vertical direction completely covers the second folding section.

A sink includes a sink body and the connector for installing a sink as claimed above; the connector is welded to a side of the sink body.

A sink assembly includes an installing platform and the sink as claimed above; and the installing platform is provided with an opening, the sink is clamped on the opening through the connector, and ends of the first folding section and the second folding section abut against a boundary surface of the opening.

The beneficial effects of the present invention are: the elastic member of the present invention is cut and bent at a middle part of the first elastic pressing part to form a second elastic pressing part, and the second folding section on the second elastic pressing part is located just below the first folding section on the first elastic pressing part, thereby sharing part of a force while shortening the force arm and further improving the fatigue resistance of the elastic member.

BRIEF DESCRIPTION OF DRAWINGS

The present invention will be further explained below in conjunction with the description of the accompanying drawings and specific embodiments.

In the figures: 1—main body, 11—transverse part, 12—vertical part, 13—curved part, 14—elastic member, 141—first elastic pressing part, 1411—first folding section, 142—second elastic pressing part, 1421—second folding section, 15—third elastic pressing part, 151—third folding section, 2—installing platform, 21—opening, 22—boundary surface, 3—sink body, 4—connecting strip.

DESCRIPTION OF EMBODIMENTS

This section will describe the specific embodiments of the present invention in detail. The preferred embodiments of the present invention are shown in the accompanying drawings. The function of the accompanying drawings is to supplement the statement of the text part of the description with graphics, so that people can intuitively and vividly understand each technical feature and overall technical solution of the present invention. However, the accompanying drawings shall not be construed as a limitation to the protection scope of the present invention.

In the statement of the present invention, it should be understood that orientation statements, such as orientation or position relationships indicated by up, down, front, back, left, right, etc., are based on the orientation or position relationships shown in the accompanying drawings and are only to facilitate the statement of the present invention and simplify the statement, rather than indicate or imply that the device or element referred to must have a specific orientation, be constructed and operate in a specific orientation, and therefore should not be understood as a limitation to the present invention.

In the statement of the present invention, "several" means one or more, "a plurality of" means two or more, "greater than", "less than", and "more than", etc. are understood to exclude the original number, and above, below, within, etc. are understood to include the original number. If there is a statement of first and second, it is only for the purpose of distinguishing technical features, and cannot be understood as indicating or implying the relative importance or implicitly indicating the number of indicated technical features or implicitly indicating the order of indicated technical features.

In the statement of the present invention, unless otherwise explicitly specified, words such as setting, installation, and connection should be understood in a broad sense. Those skilled in the art can reasonably determine the specific meanings of the above words in the present invention in combination with the specific content of the technical solution.

Figure 1:
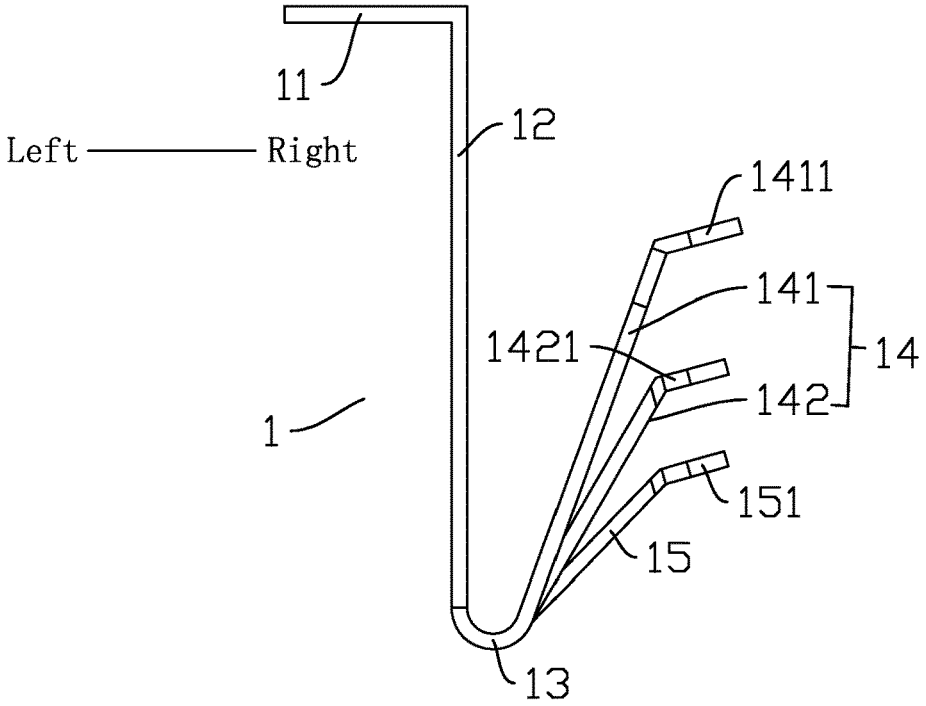
FIG. 1 is a structural front view of a connector for installing a sink in the present invention.
Figure 3:
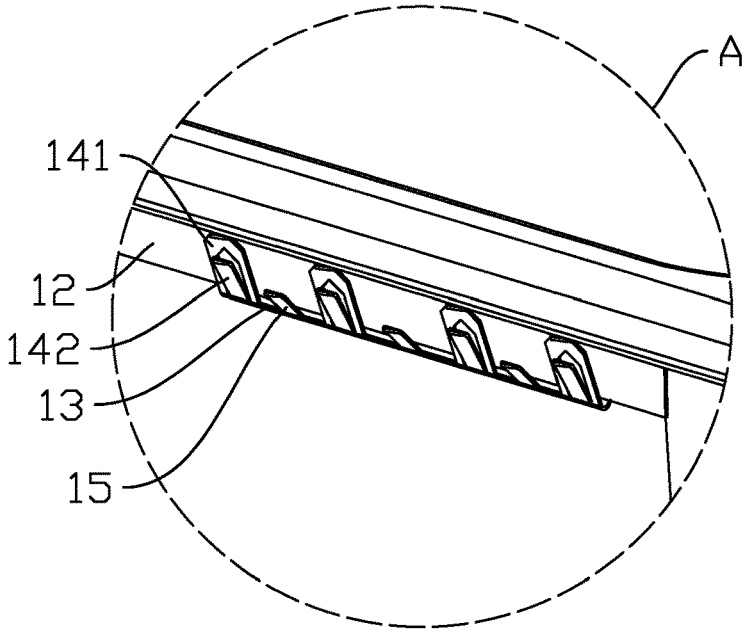
FIG. 3 is an enlarged view of a structure at A in FIG. 2.

With reference to FIGS. 1 and 3, a connector for installing a sink includes an integrally formed main body 1. The main body 1 is a stamped bending piece made of a metal material, preferably stainless steel. The main body 1 includes a vertical part 12, a lower end of the vertical part 12 is bent to an upper right to form a curved part 13. The curved part 13 is equivalent to a fulcrum for resisting against an external force. A partial position of the curved part 13 extends to the upper right with several elastic members 14. The elastic member 14 includes a first elastic pressing part 141 and a second elastic pressing part 142, the second elastic pressing part 142 is formed by cutting and bending a middle entity of the first elastic pressing part 141, and a certain gap is left between both sides of the second elastic pressing part 142 and the first elastic pressing part 141. Upper ends of the first elastic pressing part 141 and the second elastic pressing part 142 are folded rightward to form a first folding section 1411 and a second folding section 1421. The second folding section 1421 is located right below the first folding section 1411. A force arm is shortened for the setting of the second folding section 1421 relative to the first folding section 1411. Under the condition of the same force, the curved part 13 connected to the second elastic pressing part 142 is less prone to deformation, thus sharing the force on the first folding section 1411 and improving the fatigue resistance of the elastic member 14.

In a preferred embodiment, a partial area of the curved part 13 also extends to the upper right with several third elastic pressing parts 15. Upper ends of the third elastic pressing parts 15 are folded rightward to form a third folding section 151. A height of the third folding section 151 is lower than that of the second folding section 1421. Three layers of force-bearing points are formed in the vertical direction, further sharing the force borne by the elastic member 14, and improving the fatigue resistance of the main body 1.

In some embodiments, an angle between the third elastic pressing part 15 and the vertical part 12 is greater than an angle between the second elastic pressing part 142 and the vertical part 12, an angle between the second elastic pressing part 142 and the vertical part 12 is greater than an angle between the first elastic pressing part 141 and the vertical part 12, an angle between the third elastic pressing part 15 and the second elastic pressing part 142 is greater than an angle between the second elastic pressing part 142 and the first elastic pressing part 141, and an angle between the third elastic pressing part 15 and the vertical part 12 is less than or equal to 45°.

In some embodiments, the elastic member 14 and the third elastic pressing part 15 are alternately arranged on the curved part 13 so that the connector is evenly stressed.

In some embodiments, the main body 1 further includes a transverse part 11, the transverse part 11 is located at an upper end of the vertical part 12, and the transverse part 11 is used for welding with the sink body 3.

In some embodiments, a projection of the first folding section 1411 in a vertical direction completely covers the second folding section 1421.

Figure 2:
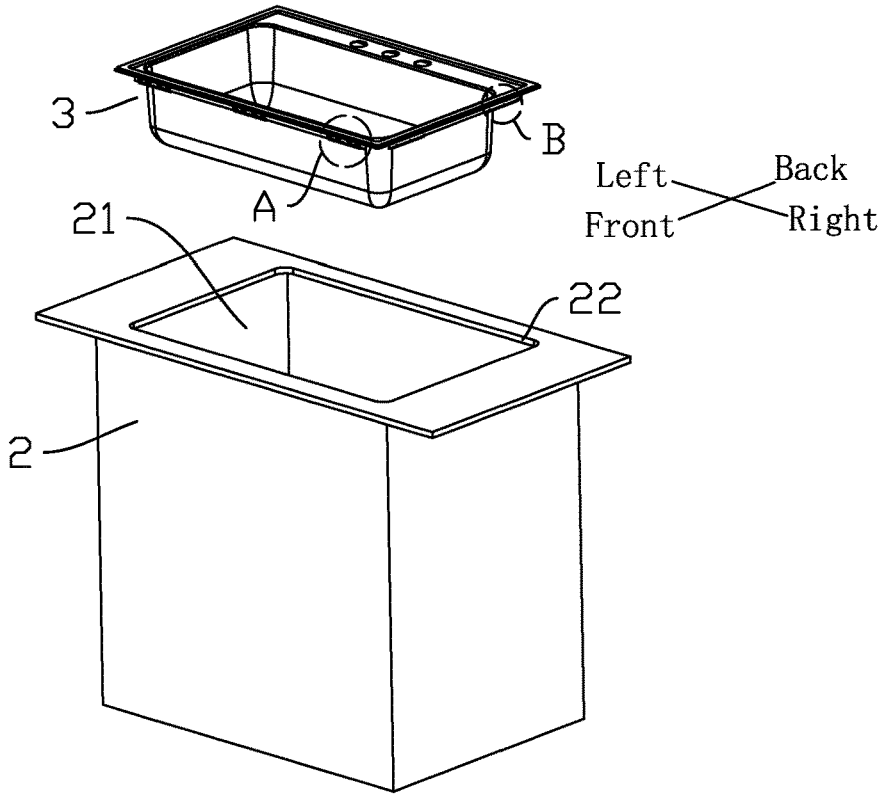
FIG. 2 is an exploded view of a structure of a sink assembly in the present invention.
Figure 5:
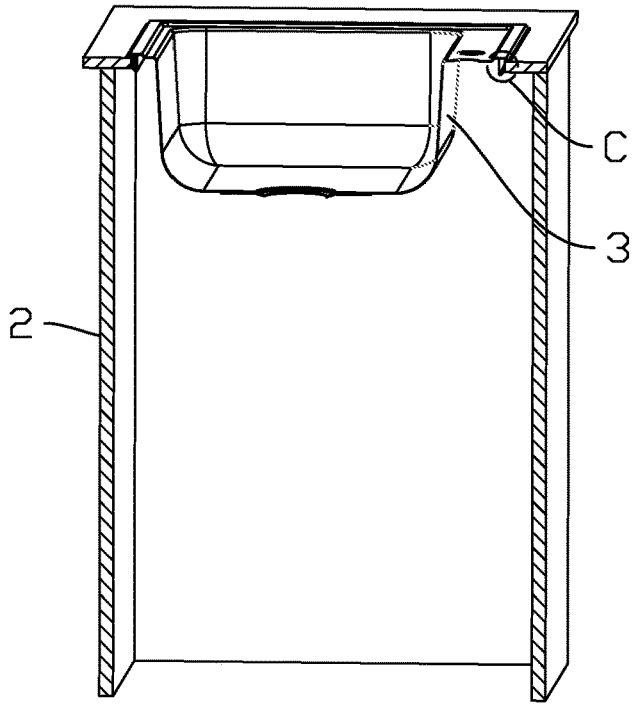
FIG. 5 is a structural cross-sectional view of a sink assembly in the present invention.
Figure 6:
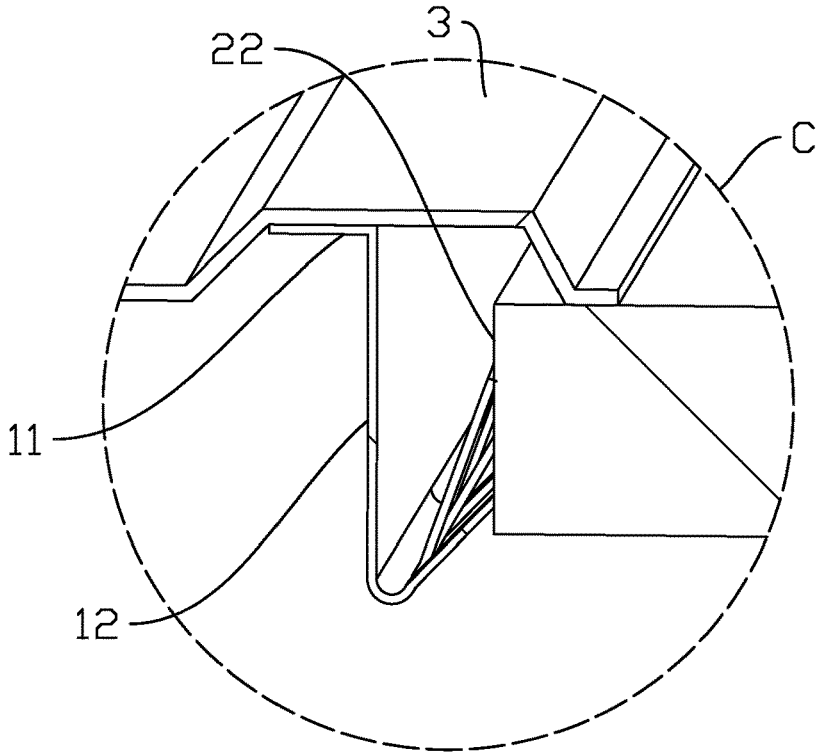
FIG. 6 is an enlarged view of a structure at C in FIG. 5.

In conjunction with FIGS. 2, 5 and 6, a sink assembly includes an installing platform 2, a sink body 3 and the connector for installing a sink body 3 as described above. The installing platform 2 is provided with an opening 21, the sink body 3 is clamped on the opening 21 through the connector, and ends of the first folding section 1411 and the second folding section 1421 abut against a boundary surface 22 of the opening 21.

Figure 4:
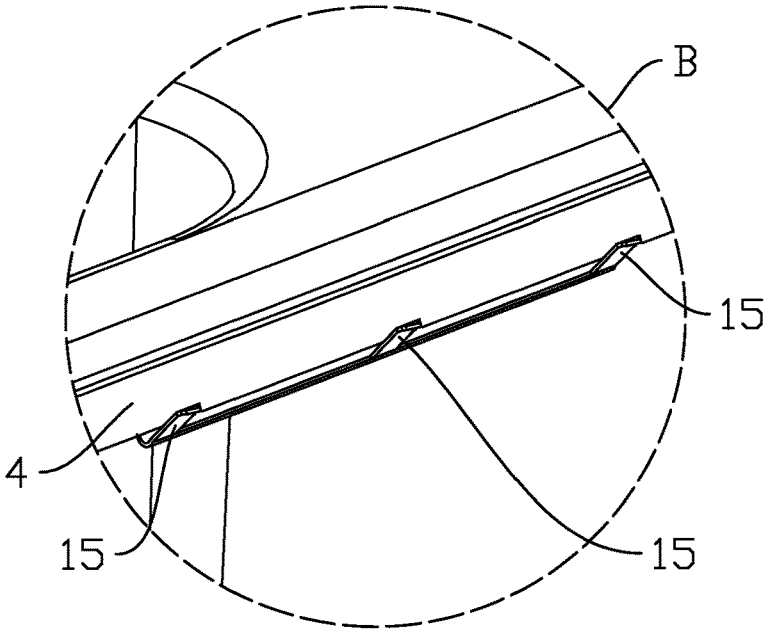
FIG. 4 is an enlarged view of a structure at B in FIG. 2.

As shown in FIGS. 3 and 4, the connector for a sink is welded to front and rear sides of the sink body 3 (the front and rear connectors are arranged oppositely). Connecting strips 4 are welded to the left and right sides of the sink body 3. The several third elastic pressing parts are integrally provided on the connecting strips 4.

The above are only preferred embodiments of the present invention, and are not intended to limit the patent scope of the present invention. Under the inventive concept of the present invention, equivalent structural transformations made using the contents of the description and drawings of the present invention, or directly or indirectly used in other relevant technical fields are all included in the patent protection scope of the present invention.

What is claimed is:

1. A connector for installing a sink, comprising an integrally formed main body (1), wherein the main body (1) comprises a vertical part (12), a lower end of the vertical part (12) is bent to an upper right to form a curved part (13);

the curved part (13) is connected with several elastic members (14), and the elastic members (14) are inclined to the upper right;

wherein:

the elastic member (14) comprises a first elastic pressing part (141) and a second elastic pressing part (142), the second elastic pressing part (142) is formed by cutting and bending a middle entity of the first elastic pressing part (141);

upper ends of the first elastic pressing part (141) and the second elastic pressing part (142) are respectively folded rightward to form a first folding section (1411) and a second folding section (1421); and the second folding section (1421) is located below the first folding section (1411).

2. The connector for installing a sink according to claim 1, wherein:

the curved part (13) is also connected with several third elastic pressing parts (15), the third elastic pressing parts (15) are inclined to the upper right, and an upper end of the third elastic pressing part (15) is folded rightward to form a third folding section (151);

a height of the third folding section (151) is lower than that of the second folding section (1421).

3. The connector for installing a sink according to claim 2, wherein:

an angle between the third elastic pressing part (15) and the vertical part (12) is greater than an angle between the second elastic pressing part (142) and the vertical part (12), and the angle between the second elastic pressing part (142) and the vertical part (12) is greater than an angle between the first elastic pressing part (141) and the vertical part (12).

4. The connector for installing a sink according to claim 3, wherein:

an angle between the third elastic pressing part (15) and the second elastic pressing part (142) is greater than an angle between the second elastic pressing part (142) and the first elastic pressing part (141).

5. The connector for installing a sink according to claim 4, wherein:

the angle between the third elastic pressing part (15) and the vertical part (12) is less than or equal to 45°.

6. The connector for installing a sink according to claim 2, wherein:

the elastic member (14) and the third elastic pressing part (15) are alternately arranged in a length direction of the main body (1).

7. The connector for installing a sink according to claim 1, wherein:

the main body (1) also comprises a transverse part (11), and the transverse part (11) is located at an upper end of the vertical part (12).

8. The connector for installing a sink according to claim 1, wherein:

a projection of the first folding section (1411) in a vertical direction completely covers the second folding section (1421).

9. A sink, wherein: the sink comprises a sink body (3) and the connector for installing a sink according to claim 1; the connector is welded to a side of the sink body (3).

10. A sink assembly, wherein: the sink assembly comprises an installing platform (2) and the sink according to claim 9;

the installing platform (2) is provided with an opening (21), the sink is clamped on the opening (21) through the connector, and ends of the first folding section (1411) and the second folding section (1421) abut against a boundary surface (22) of the opening (21).

* * * * *